US010815880B2

(12) United States Patent
Kwon et al.

(10) Patent No.: US 10,815,880 B2
(45) Date of Patent: Oct. 27, 2020

(54) PULLEY SYSTEM FOR CRANKSHAFT

(71) Applicants: HYUNDAI MOTOR COMPANY, Seoul (KR); KIA MOTORS CORPORATION, Seoul (KR)

(72) Inventors: Hee Do Kwon, Gunpo-si (KR); In Jae Seo, Seoul (KR); Kye Oong Song, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 133 days.

(21) Appl. No.: 15/986,988

(22) Filed: May 23, 2018

(65) Prior Publication Data

US 2019/0136758 A1 May 9, 2019

(30) Foreign Application Priority Data

Nov. 8, 2017 (KR) ..... 10-2017-0148074

(51) Int. Cl.
*F02B 67/06* (2006.01)
*F02B 77/08* (2006.01)
*F01L 1/02* (2006.01)

(52) U.S. Cl.
CPC ..... *F02B 77/081* (2013.01); *F01L 1/024* (2013.01); *F02B 67/06* (2013.01); *F01L 2301/00* (2020.05)

(58) Field of Classification Search
CPC ..... F01L 1/024; F01L 2101/00; F02B 67/06; F02B 77/081
USPC ..... 123/195 R, 195 C, 198 D, 198 E
See application file for complete search history.

(56) References Cited

U.S. PATENT DOCUMENTS 4,373,480 A * 2/1983 Shikata ..... F02B 67/06 123/195 A
4,559,910 A * 12/1985 Tsuchiyama ..... F01M 1/06 123/195 R
5,580,325 A * 12/1996 Hirota ..... F02B 77/081 474/144
6,308,673 B1 * 10/2001 Kobayashi ..... F01L 1/02 123/195 C (Continued)

FOREIGN PATENT DOCUMENTS

JP 58072620 A * 4/1983 ..... F02F 7/006
JP 08151932 A * 6/1996
JP 2011-237002 A 11/2011

(Continued)

*Primary Examiner* — George C Jin
*Assistant Examiner* — Teuta B Holbrook
(74) *Attorney, Agent, or Firm* — Brinks Gilson & Lione

(57) ABSTRACT

There is provided a pulley system for a crankshaft, the pulley system including: a crankshaft rotatably supported by a cylinder block; a crank pulley connected to one end of the crankshaft, and having an accessory belt wrapped the crank pulley; a crank timing pulley connected to one end of the crankshaft, and having a timing belt wrapped around the crank timing pulley; a timing belt cover mounted on a front wall of the cylinder block, and having an opening through which a portion of the crank pulley passes; and a stopper structure restricting the accessory belt from moving into an inner space of the timing belt cover. In particular, the timing belt and the crank timing pulley are placed in the inner space of the timing belt cover, and the crank pulley is placed in an outer space of the timing belt cover.

16 Claims, 10 Drawing Sheets

(56) References Cited

U.S. PATENT DOCUMENTS 7,044,100 B2 * 5/2006 Stone ..... F01L 1/02
123/198 R

FOREIGN PATENT DOCUMENTS

| | | | |
|---|---|---|---|
| JP | 5939613 | B2 * | 6/2016 |
| JP | 2016-194365 | A | 11/2016 |
| KR | 10-0282916 | B1 | 9/2001 |
| KR | 10-1246611 | B1 | 3/2013 |
| KR | 10-1671976 | B1 | 11/2016 |

* cited by examiner

PULLEY SYSTEM FOR CRANKSHAFT

CROSS-REFERENCE TO RELATED APPLICATION

This application claims priority to and the benefit of Korean Patent Application No. 10-2017-0148074, filed on Nov. 8, 2017, which is incorporated herein by reference in its entirety.

FIELD

The present disclosure relates to a pulley system for a crankshaft.

BACKGROUND

The statements in this section merely provide background information related to the present disclosure and may not constitute prior art.

An internal combustion engine combusts a fuel mixed with an oxidizer (usually air) in a combustion chamber to obtain energy. The expansion of high-temperature and high-pressure gases produced by the combustion of the mixed fuel in the combustion chamber pushes pistons of the engine to operate the engine. Such an operating method of the internal combustion engine is in contrast to external combustion engines, such as steam or Stirling engines, using heat out of the engine.

The internal combustion engine includes a cylinder block having at least one cylinder, a cylinder head provided on the cylinder block, at least one piston reciprocating in each cylinder, a crankshaft converting the reciprocating motion of the piston into rotational motion, and at least one connecting rod connecting each piston and the crankshaft.

The crankshaft transfers the output of the engine to the outside by converting the reciprocating motion of the piston into the rotational motion in a power stroke, and transfers the motion to the piston in an intake stroke, a compression stroke, and an exhaust stroke.

A crank pulley and a crank timing pulley may be connected to one end of the crankshaft. A flywheel may be connected to the other end of the crankshaft to reduce the pulsation characteristics of the four-stroke cycle.

An accessory belt may be wrapped around the crank pulley, and may drive a pulley of a water pump, a pulley of an alternator, a pulley of a compressor, and the like. A timing belt, a timing chain or a cam belt, may be wrapped around the crank timing pulley, and may synchronize the rotation of the crankshaft and the camshaft(s) so that the engine's valves open and close at the proper times during each cylinder's intake and exhaust strokes.

The crank timing pulley may be covered with a timing belt cover, and the crank pulley may be exposed to an outer space of the timing belt cover. The timing belt cover may have an opening, and the crank pulley may be disposed adjacent to the opening of the timing belt cover. The crank pulley may be spaced apart from the opening of the timing belt cover by a predetermined gap so that interference between the crank pulley and the timing belt cover may be prevented.

We have discovered that, when the accessory belt is damaged or is disengaged from the crank pulley due to misalignment or the like, at least a portion of the accessory belt may move into the opening of the timing belt cover so that the accessory belt may be wrapped around the crank timing pulley. As the accessory belt is wrapped around the crank timing pulley, tooth-jumping may occur between the timing belt and the crank timing pulley, which may cause interference between the piston and the valve, resulting in serious damage to the engine.

SUMMARY

The present disclosure has been made to solve the above-mentioned problems in the prior art while advantages achieved by the prior art are maintained intact.

An aspect of the present disclosure provides a pulley system for a crankshaft, capable of restricting or preventing an accessory belt, which is disengaged from a crank pulley, from moving into an inner space of a timing belt cover, which may result in wrapped around a crank timing pulley.

According to an aspect of the present disclosure, a pulley system for a crankshaft may include: a crankshaft rotatably supported by a cylinder block; a crank pulley connected to one end of the crankshaft; an accessory belt wrapped around the crank pulley; a crank timing pulley connected to one end of the crankshaft; a timing belt wrapped around the crank timing pulley; a timing belt cover mounted on a front wall of the cylinder block, and having an opening through which a portion of the crank pulley passes; and a stopper structure configured to restrict the accessory belt, which is disengaged from the crank pulley, from moving into an inner space of the timing belt cover. In particular, the timing belt and the crank timing pulley are placed in the inner space of the timing belt cover, and the crank pulley is placed in an outer space of the timing belt cover.

The stopper structure may include a stopper protruding from the crank pulley in an outer diameter direction.

The crank pulley may include a rim having an annular shape, and a hub extending from the rim, the hub may pass through the opening of the timing belt cover, and an outer circumferential surface of the hub may be spaced apart from an inner circumferential surface of the opening in a radial direction.

The stopper may protrude from the hub in the outer diameter direction.

The stopper may be placed in the inner space of the timing belt cover.

A predetermined first gap may be formed between the outer circumferential surface of the hub and the inner circumferential surface of the opening, a predetermined second gap may be formed between the stopper and an edge portion of the opening, and the second gap may be smaller than the first gap.

The stopper may be placed in the outer space of the timing belt cover.

A predetermined first gap may be formed between the outer circumferential surface of the hub and the inner circumferential surface of the opening, a predetermined third gap may be formed between the stopper and an outer surface of the timing belt cover, and the third gap may be smaller than the first gap.

The stopper structure may include a stopper groove provided in the crank pulley in an inner diameter direction.

The stopper groove may be positioned to face the inner circumferential surface of the opening.

An outer diameter of the stopper may be greater than or equal to an inner diameter of the opening.

An outer diameter of the stopper may be smaller than an inner diameter of the opening.

The stopper structure may include a stopper plate connected to an edge portion of the hub, and an edge portion of the stopper plate may protrude from the hub in the outer diameter direction.

The stopper plate may be placed in the inner space of the timing belt cover.

The crank pulley may be connected to the crank timing pulley.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
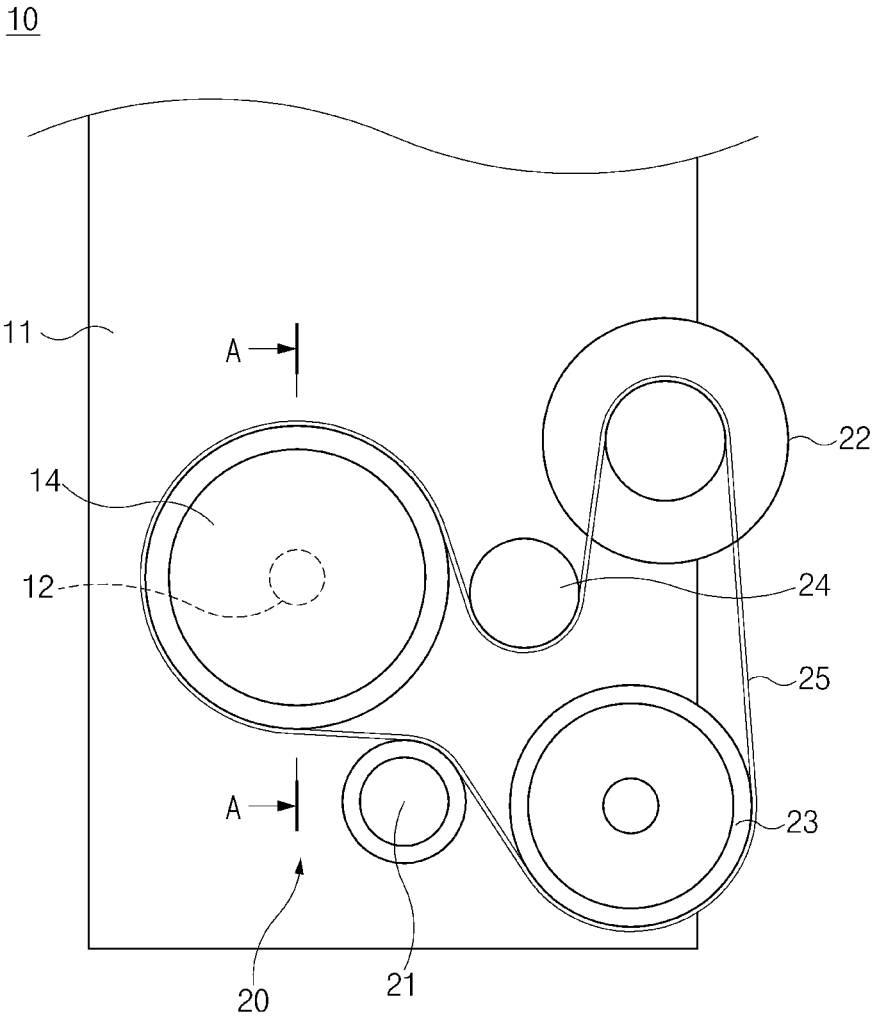
FIG. 1 illustrates a front view of an internal combustion engine equipped with a pulley system for a crankshaft according to an exemplary form of the present disclosure.

The drawings described herein are for illustration purposes only and are not intended to limit the scope of the present disclosure in any way.

DETAILED DESCRIPTION

Hereinafter, exemplary forms of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary forms of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 2:
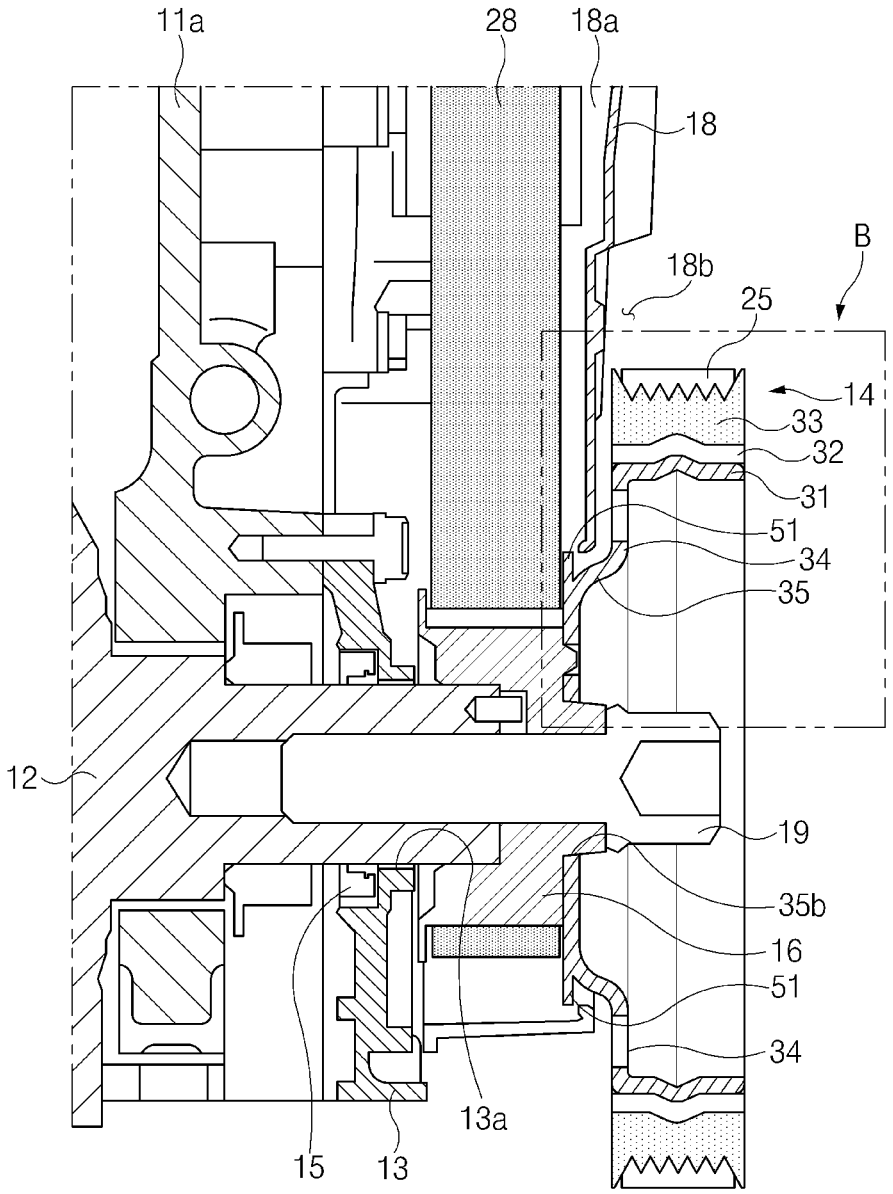
FIG. 2 illustrates a cross-sectional view taken along line A-A of FIG. 1.

Referring to FIGS. 1 and 2, a pulley system for a crankshaft, according to an exemplary form of the present disclosure, may include a crankshaft 12 rotatably supported by a cylinder block 11 of an internal combustion engine 10, and a crank pulley 14 and a crank timing pulley 16 connected to one end of the crankshaft 12.

A cylinder head (not shown) may be provided on the top of the cylinder block 11, and an oil pan (not shown) may be provided on the bottom of the cylinder block 11.

As illustrated in FIG. 2, the crankshaft 12 may be rotatably supported by a front wall 11*a* of the cylinder block 11.

A front cover 13 (or a front wall of the oil pan) may be fastened to the front wall 11*a* of the cylinder block 11 through fasteners or the like. The front cover 13 may have an opening 13*a* through which one end of the crankshaft 12 passes, and an oil seal 15 may be provided on an inner circumferential surface of the opening 13*a* of the front cover 13. The oil seal 15 may restrict or prevent oil from being leaked from the cylinder block 11 to the outside.

The crank pulley 14 and the crank timing pulley 16 may be connected to one end of the crankshaft 12. The crank pulley 14 and the crank timing pulley 16 may be disposed adjacent to each other. A flywheel (not shown) may be connected to the other end of the crankshaft 12 to reduce the pulsation characteristics of a four-stroke cycle.

An accessory belt 25 may be wrapped around the crank pulley 14, and the accessory belt 25 may drive a plurality of driven pulleys 22 and 23 to be described later.

The crank pulley 14 may include a rim 31, an elastomeric element 32 attached to an outer circumferential surface of the rim 31, an outer member 33 attached to an outer circumferential surface of the elastomeric element 32, and a hub 35 connected to the rim 31.

The rim 31 may have an annular shape. The rim 31 may have a bend portion 31*a* protruding from a middle portion of the rim 31 in an outer diameter direction. The bend portion 31*a* may increase stiffness of the rim 31.

The elastomeric element 32 may be attached to the outer circumferential surface of the rim 31. The elastomeric element 32 may have an annular shape to correspond to the outer circumferential surface of the rim 31. The elastomeric element 32 may have a bend portion 32*a* corresponding to the bend portion 31*a* of the rim 31 such that the bend portion 31*a* of the rim 31 may be attached to the bend portion 32*a* of the elastomeric element 32.

The elastomeric element 32 may be interposed between the rim 31 and the outer member 33 so that the crank pulley 14 may secure damping performance. Here, the crank pulley 14 may also be referred to as a crank damper pulley.

The outer member 33 may be attached to the outer circumferential surface of the elastomeric element 32, and an inner circumferential surface of the outer member 33 may be attached to the outer circumferential surface of the elastomeric element 32. The outer member 33 may have an engaging groove 33*b* corresponding to the bend portion 32*a* of the elastomeric element 32 such that the bend portion 32*a* of the elastomeric element 32 may be fitted into the engaging groove 33*b* of the outer member 33.

The accessory belt 25 may be wrapped around the outer member 33, and an outer circumferential surface of the outer member 33 may be provided with one or more grooves 33*a* with which teeth of the accessory belt 25 mesh.

The hub 35 may be connected to the rim 31 through a plurality of spokes 34, and the hub 35 may protrude from the rim 31 in an axial direction.

According to an exemplary form, as illustrated in FIG. 2, the crank pulley 14 may be connected to the crankshaft 12 via the crank timing pulley 16 such that the crank pulley 14 and the crank timing pulley 16 may rotate with the crankshaft 12. The hub 35 may have an opening 35*b*. The opening 35*b* of the hub 35 and the crank timing pulley 16 may be press-fitted or fastened using fasteners or the like such that the crank pulley 14 may be connected to the crank timing pulley 16. As the crank pulley 14 and the crank timing pulley 16 are connected as described above, an accessory drive system 20 may be provided in a compact form on the front side of the cylinder block 11, thereby improving the space utilization of an engine compartment of a vehicle.

According to another exemplary form, the crank pulley 14 and the crank timing pulley 16 may be individually connected to the crankshaft 12 through fasteners (not shown) or the like.

As illustrated in FIG. 1, the accessory drive system 20 may be disposed on the front side of the cylinder block 11, and the accessory drive system 20 may include the crank pulley 14 connected to one end of the crankshaft 12, the plurality of driven pulleys 22 and 23 adjacent to the crank pulley 14, the accessory belt 25 connecting the crank pulley 14 and the plurality of driven pulleys 22 and 23, and one or more tension rollers 21 and 24 tensioning the accessory belt 25.

A timing belt 28, or a timing chain, may be wrapped around the crank timing pulley 16 and the timing belt 28 may synchronize the rotation of the crankshaft 12 and a camshaft so that intake and exhaust valves open and close at proper timings during an intake stroke and an exhaust stroke.

The crank timing pulley 16 may be connected to one end of the crankshaft 12 through a fastener 19.

Figure 3:
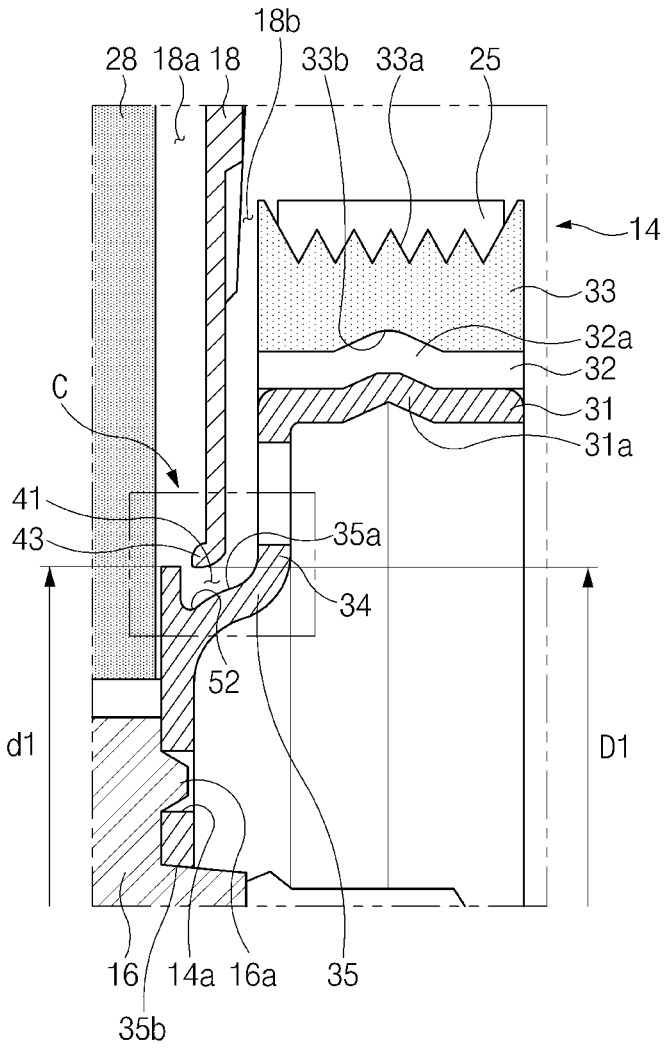
FIG. 3 illustrates an enlarged view of a portion indicated by arrow B of FIG. 2.

According to an exemplary form, as illustrated in FIG. 3, a protrusion 16*a* may protrude from one side surface of the crank timing pulley 16 toward the crank pulley 14, and a hole 14*a* may be formed in the hub 35 of the crank pulley 14. The protrusion 16*a* of the crank timing pulley 16 may be fitted into the hole 14*a* of the crank pulley 14 such that the crank pulley 14 may be firmly connected to the crank timing pulley 16.

A timing belt cover 18 may be mounted on the front wall 11*a* of the cylinder block 11. The crank timing pulley 16 and the timing belt 28 may be placed in an inner space 18*a* of the timing belt cover 18 such that the timing belt cover 18 may cover the crank timing pulley 16 and the timing belt 28. The crank pulley 14 may be placed in an outer space 18*b* of the timing belt cover 18.

The timing belt cover 18 may have an opening 41 through which the hub 35 of the crank pulley 14 passes. The timing belt cover 18 may have an edge portion 43 defining the opening 41, and the edge portion 43 may increase stiffness around the opening 41. The edge portion 43 may protrude toward the inner space 18*a* of the timing belt cover 18 to restrict or prevent interference with the crank pulley 14.

An outer circumferential surface 35*a* of the hub 35 may be spaced apart from an inner circumferential surface 41*a* of the opening 41 in a radial direction. A predetermined first gap g1 may be formed between the outer circumferential surface 35*a* of the hub 35 and the inner circumferential surface 41*a* of the opening 41. The first gap g1 may be smaller than a thickness of the accessory belt 25 such that the accessory belt 25 disengaged from the crank pulley 14 may be restricted or prevented from moving into the inner space 18*a* of the timing belt cover 18.

Meanwhile, even when the first gap g1 is smaller than the thickness of the accessory belt 25, the accessory belt 25 might be damaged or is disengaged from the crank pulley 14 due to misalignment or the like so that a portion of the accessory belt 25 may move into the inner space 18*a* of the timing belt cover 18 through the opening 41 and the accessory belt 25 may be wrapped around the crank timing pulley 16.

When the accessory belt 25 is wrapped around the crank timing pulley 16, tooth jumping may occur between the timing belt 28 and the crank timing pulley 16, which may cause interference between the piston and the valve, resulting in serious damage to the engine.

As described above, in order to restrict or prevent the accessory belt 25 from moving into the inner space 18*a* of the timing belt cover 18 through the opening 41, a stopper structure may be provided on the outer circumferential surface of the hub 35 of the crank pulley 14.

Figure 4:
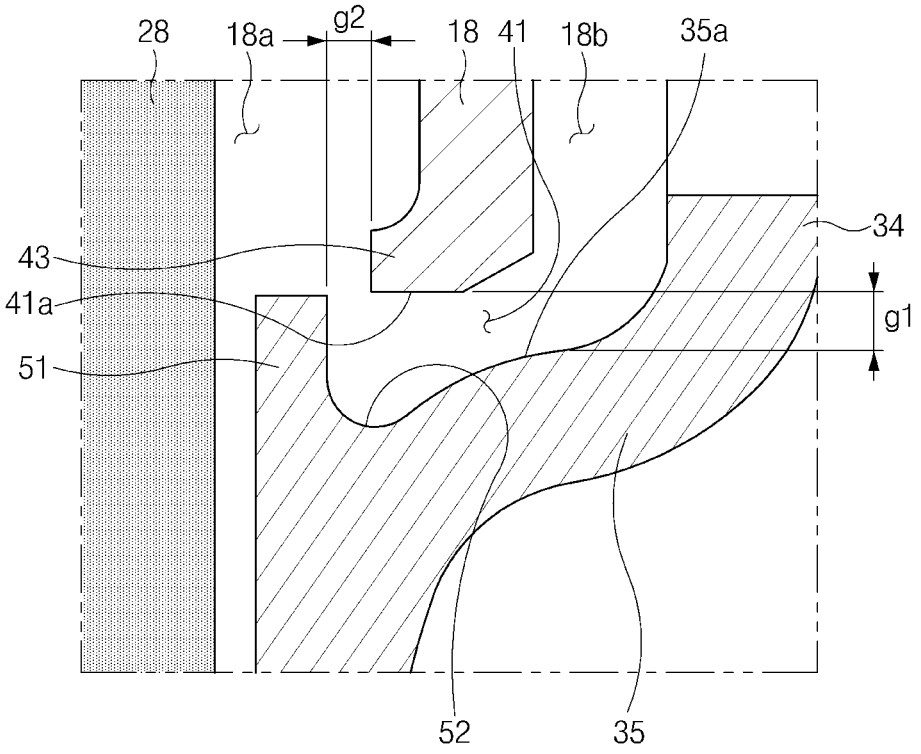
FIG. 4 illustrates an enlarged view of a portion indicated by arrow C of FIG. 3.

According to an exemplary form, as illustrated in FIGS. 2 to 4, the stopper structure may include a stopper 51 protruding from an edge portion of the hub 35 in the outer diameter direction. The stopper 51 may be placed in the inner space 18*a* of the timing belt cover 18. As the stopper 51 protrudes from the edge portion of the hub 35 in the outer diameter direction, a stopper groove 52 may be formed between the stopper 51 and the outer circumferential surface of the hub 35 to receive the accessory belt 25.

An outer diameter d1 of the stopper 51 may be greater than or equal to an inner diameter D1 of the opening 41 ($d1 \geq D1$). The stopper 51 may be spaced apart from the edge portion 43 of the opening 41 by a predetermined second gap g2, and the second gap g2 may be smaller than the first gap g1. The second gap g2 may be much smaller than the thickness of the accessory belt 25.

Thus, the accessory belt 25 disengaged from the crank pulley 14 may be blocked by the stopper 51 and be received in the stopper groove 52 so that the accessory belt 25 may be restricted or prevented from moving into the inner space 18*a* of the timing belt cover 18.

Figure 5:
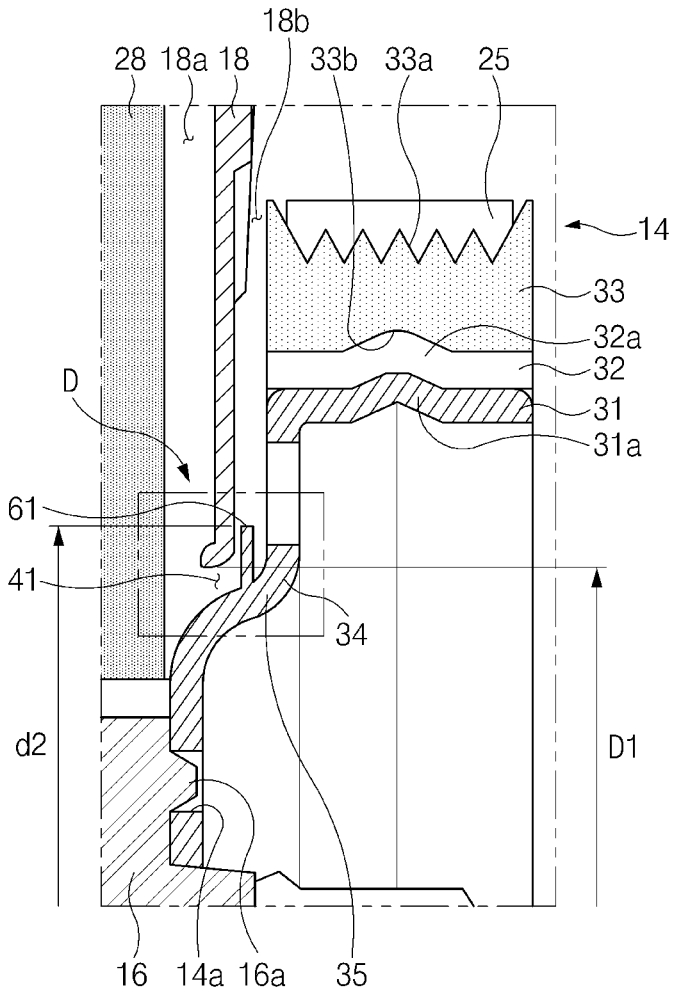
FIG. 5 illustrates an example of a stopper structure different from that illustrated in FIG. 3, according to another exemplary form of the present disclosure.
Figure 6:
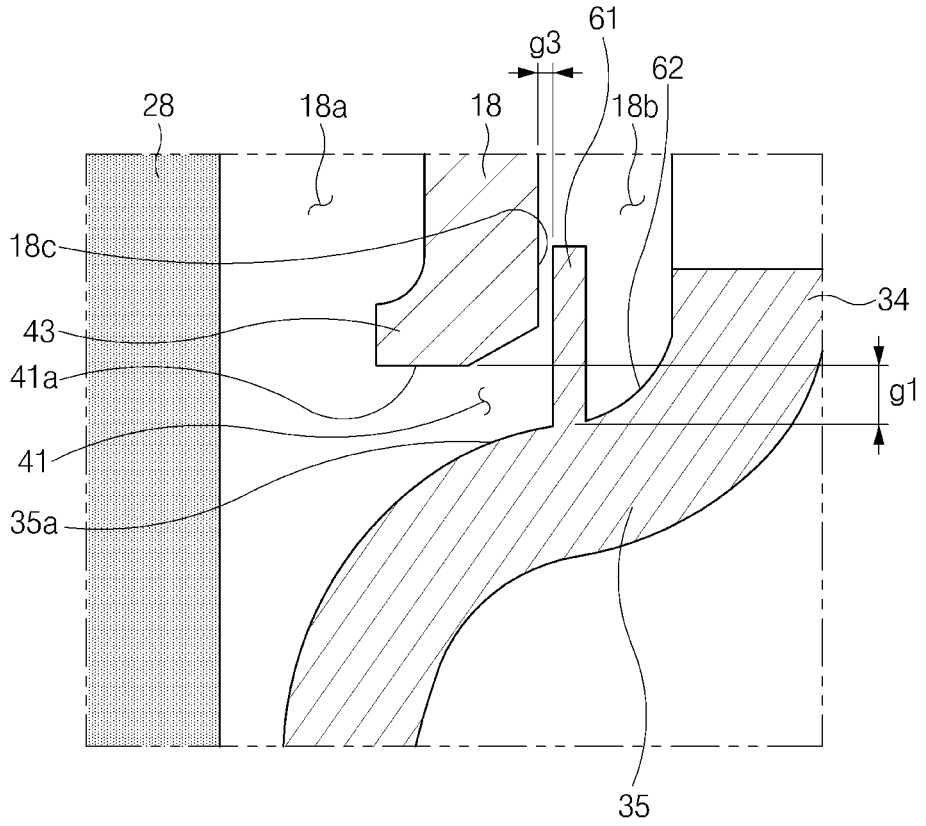
FIG. 6 illustrates an enlarged view of a portion indicated by arrow D of FIG. 5.

According to another exemplary form, as illustrated in FIGS. 5 and 6, the stopper structure may include a stopper 61 protruding from a middle portion of the hub 35 in the outer diameter direction. The stopper 61 may be placed in the outer space 18*b* of the timing belt cover 18. As the stopper 61 protrudes from the middle portion of the hub 35 in the outer diameter direction, a stopper groove 62 may be formed between the stopper 61 and the outer circumferential surface of the hub 35 to receive the accessory belt 25.

An outer diameter d2 of the stopper 61 may be greater than the inner diameter D1 of the opening 41 ($d2 > D1$). The stopper 61 may be spaced apart from an outer surface 18*c* of the timing belt cover 18 by a predetermined third gap g3, and the third gap g3 may be smaller than the first gap g1. The third gap g3 may be much smaller than the thickness of the accessory belt 25.

Thus, the accessory belt 25 disengaged from the crank pulley 14 may be blocked by the stopper 61 and be received in the stopper groove 62 so that the accessory belt 25 may be restricted or prevented from moving into the opening 41. As the stopper 61 is placed in the outer space 18*b* of the timing belt cover 18, the accessory belt 25 disengaged from the crank pulley 14 may be restricted or prevented from moving into the inner space 18*a* of the timing belt cover 18 more reliably.

Figure 7:
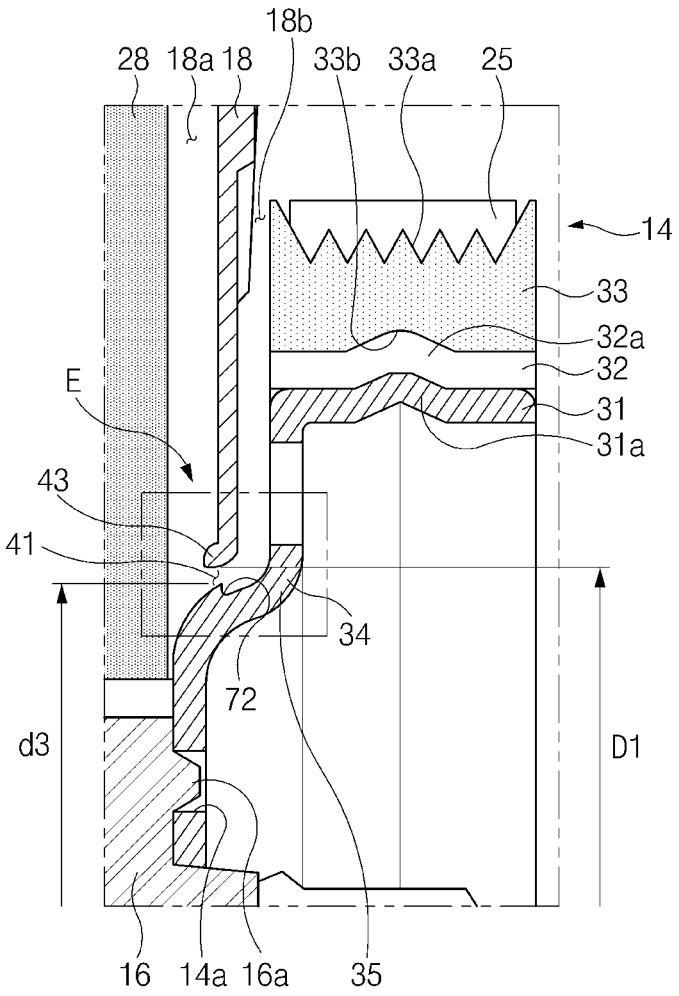
FIG. 7 illustrates an example of a stopper structure different from that illustrated in FIG. 3, according to another exemplary form of the present disclosure.
Figure 8:
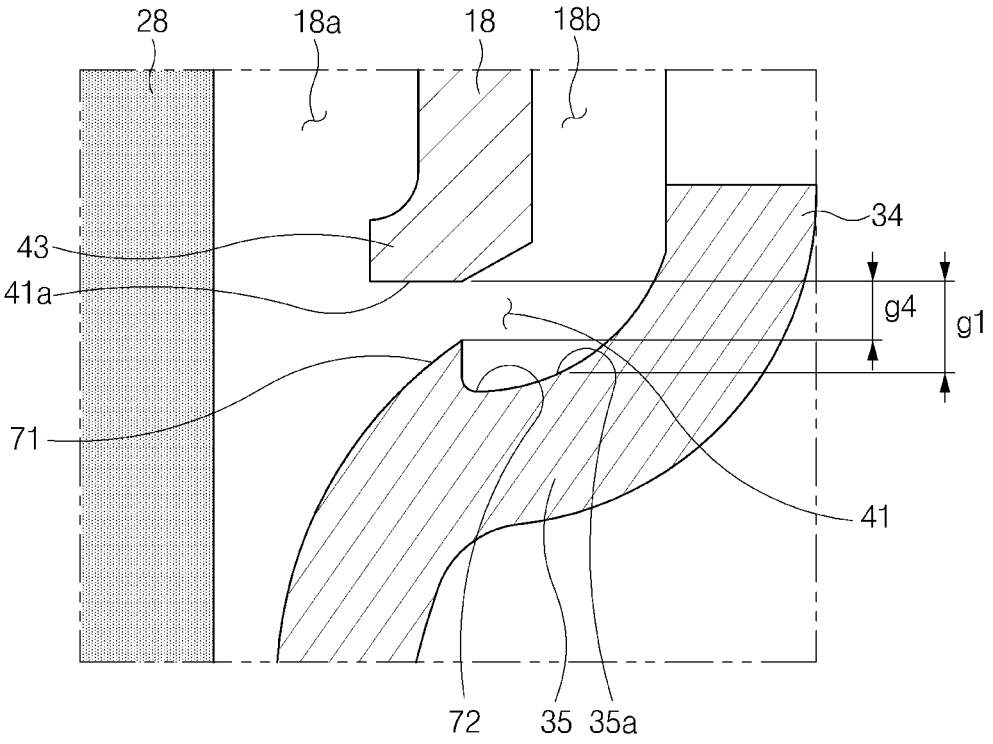
FIG. 8 illustrates an enlarged view of a portion indicated by arrow E of FIG. 7.

According to another exemplary form, as illustrated in FIGS. 7 and 8, the stopper structure may include a stopper groove 72 that is recessed inwardly in the outer circumferential surface 35*a* of the hub 35. The stopper groove 72 may be formed to face the inner circumferential surface 41*a* of the opening 41. As the stopper groove 72 is recessed in the outer circumferential surface 35*a* of the hub 35, a stopper 71 may be formed to protrude in a direction opposite to the stopper groove 72. The stopper 71 may be curved to correspond to the outer circumferential surface of the hub 35, and the stopper 71 may be formed to face the inner circumferential surface 41*a* of the opening 41.

An outer diameter d3 of the stopper 71 may be smaller than the inner diameter D1 of the opening 41 (d3<D1). The stopper 71 may be spaced apart from the edge portion 43 of the opening 41 by a predetermined fourth gap g4, and the fourth gap g4 may be smaller than the first gap g1. The fourth gap g4 may be much smaller than the thickness of the accessory belt 25.

Thus, the accessory belt 25 disengaged from the crank pulley 14 may be blocked by the stopper 71 and be received in the stopper groove 72 so that the accessory belt 25 may be restricted or prevented from moving into the inner space 18*a* of the timing belt cover 18.

Figure 9:
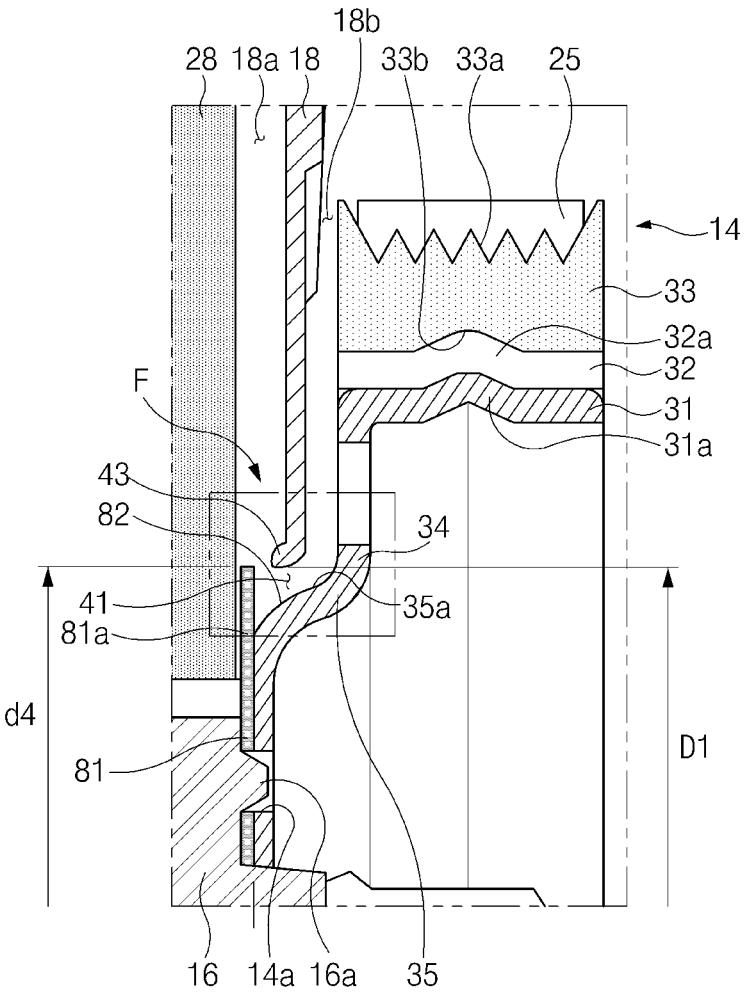
FIG. 9 illustrates an example of a stopper structure different from that illustrated in FIG. 3, according to another exemplary form of the present disclosure.
Figure 10:
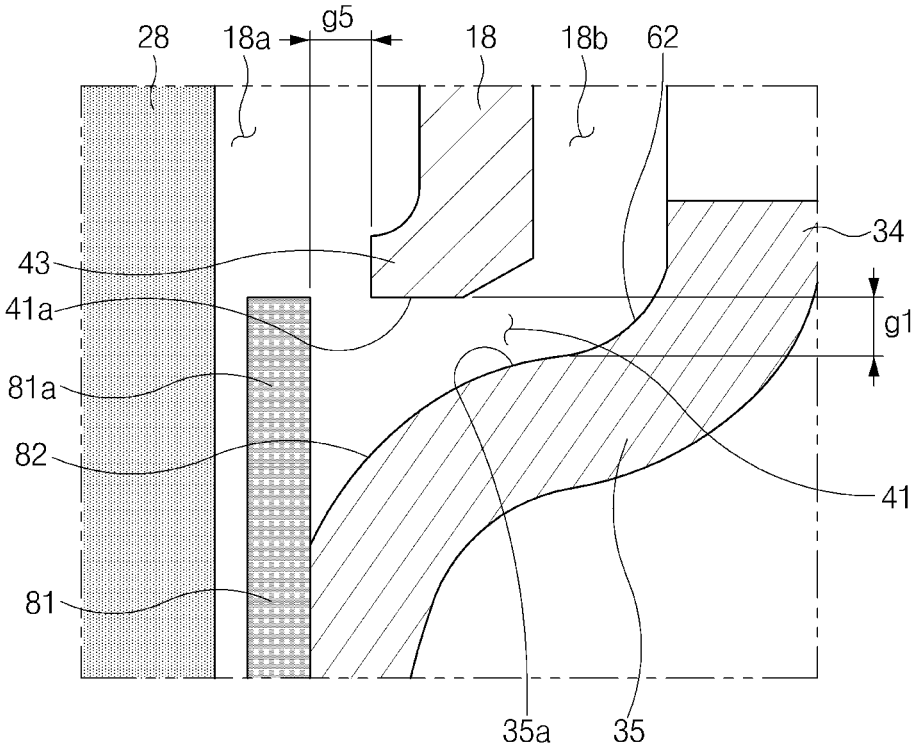
FIG. 10 illustrates an enlarged view of a portion indicated by arrow F of FIG. 9.

According to another exemplary form, as illustrated in FIGS. 9 and 10, the stopper structure may include a stopper plate 81 connected to the edge portion of the hub 35 by welding or using fasteners, and the stopper plate 81 may be placed in the inner space 18*a* of the timing belt cover 18.

An edge portion 81*a* of the stopper plate 81 may protrude from the hub 35 in the outer diameter direction. As the edge portion 81*a* protrudes from the hub 35 in the outer diameter direction, a stopper groove 82 may be formed between the edge portion 81*a* and the outer circumferential surface 35*a* of the hub 35 to receive the accessory belt 25.

An outer diameter d4 of the stopper plate 81 may be greater than or equal to the inner diameter D1 of the opening 41 (d4≥D1). The edge portion 81*a* of the stopper plate 81 may be spaced apart from the edge portion 43 of the opening 41 by a predetermined fifth gap g5, and the fifth gap g5 may be smaller than the first gap g1. The fifth gap g5 may be much smaller than the thickness of the accessory belt 25.

Thus, the accessory belt 25 disengaged from the crank pulley 14 may be blocked by the edge portion 81*a* of the stopper plate 81 and be received in the stopper groove 82 so that the accessory belt 25 may be restricted or prevented from moving into the inner space 18*a* of the timing belt cover 18.

As set forth above, the pulley system, according to exemplary forms of the present disclosure, may restrict or prevent the accessory belt, which is disengaged from the crank pulley, from moving into the inner space of the timing belt cover and then being wrapped around the crank timing pulley, thereby restricting or preventing serious damage to the engine.

In addition, in the pulley system according to exemplary forms of the present disclosure, the crank pulley may be connected to the crank timing pulley so that the accessory drive system may be provided in a compact form on the front side of the cylinder block, thereby improving the space utilization of the engine compartment of the vehicle.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. A pulley system for a crankshaft, the pulley system comprising:

a crankshaft rotatably supported by a cylinder block;

a crank pulley connected to a first end of the crankshaft;

an accessory belt configured to wrap around the crank pulley;

a crank timing pulley connected to a second end of the crankshaft;

a timing belt configured to wrap around the crank timing pulley;

a timing belt cover mounted on a front wall of the cylinder block, and having an edge portion, wherein an inner circumferential surface of the edge portion is configured to define an opening; and a stopper structure configured to restrict the accessory belt from moving into an inner space of the timing belt cover, wherein:

the crank pulley includes a rim having an annular shape and a hub connected to the rim via a plurality of spokes, the hub is configured to extend from the plurality of spokes through the opening formed by the inner circumferential surface of the edge portion, the timing belt and the crank timing pulley are placed in the inner space of the timing belt cover, the crank pulley is placed in an outer space of the timing belt cover, the inner circumferential surface of the edge portion is configured to surround an outer circumferential surface of the hub, and the edge portion includes a protrusion part protruding from the edge portion toward the timing belt.

2. The pulley system according to claim 1, wherein the stopper structure includes a stopper protruding from the crank pulley in an outer diameter direction.

3. The pulley system according to claim 2, wherein the stopper and the hub is combined together at a point which is disposed radially inside of the opening of the edge portion, and the outer circumferential surface of the hub is spaced apart from the inner circumferential surface of the edge portion in a radial direction.

4. The pulley system according to claim 3, wherein the stopper protrudes from the hub in the outer diameter direction.

5. The pulley system according to claim 3, wherein the stopper is placed in the inner space of the timing belt cover.

6. The pulley system according to claim 5, wherein a first gap is formed between the outer circumferential surface of the hub and the inner circumferential surface of the edge portion, a second gap is formed between the stopper and the edge portion of the timing belt cover, and the second gap is smaller than the first gap.

7. The pulley system according to claim 2, wherein the stopper is placed in the outer space of the timing belt cover.

8. The pulley system according to claim 7, wherein a first gap is formed between the outer circumferential surface of the hub and the inner circumferential surface of the edge portion, a third gap is formed between the stopper and an outer surface of the timing belt cover, and the third gap is smaller than the first gap.

9. The pulley system according to claim 2, wherein the stopper structure includes a stopper groove recessed inwardly in the outer circumferential surface of the hub.

10. The pulley system according to claim 9, wherein the stopper groove is positioned to face the inner circumferential surface of the edge portion.

11. The pulley system according to claim 2, wherein an outer diameter of the stopper is greater than or equal to an inner diameter of the opening.

12. The pulley system according to claim 2, wherein an outer diameter of the stopper is smaller than an inner diameter of the opening.

13. The pulley system according to claim 2, wherein the stopper structure includes a stopper plate connected to an edge portion of the hub, and an edge portion of the stopper plate protrudes from the hub in the outer diameter direction.

14. The pulley system according to claim 13, wherein the stopper plate is placed in the inner space of the timing belt cover.

15. The pulley system according to claim 1, wherein the crank pulley is connected to the crank timing pulley.

16. The pulley system according to claim 1, wherein the rim includes a bend portion protruding from a middle portion of the rim in an outer diameter direction.

* * * * *